US005983794A

United States Patent [19]

Emery

[11] Patent Number: 5,983,794

[45] Date of Patent: Nov. 16, 1999

[54] IMPRINTER PRINTING UNIT FOR A WEB ROTARY PRINTING PRESS

[75] Inventor: David Crowell Emery, York, Me.

[73] Assignee: Heidelberger Druckmashinen AG, Heidelberg, Germany

[21] Appl. No.: 09/153,763

[22] Filed: Sep. 15, 1998

[51] Int. Cl.[6] ..... B41F 13/193; B41F 13/46

[52] U.S. Cl. ..... 101/217

[58] Field of Search ..... 101/177, 179, 101/180, 181, 182, 183, 184, 220, 221, 217, 137, 138, 142, 143, 247, 219, 218, 228

[56] References Cited

U.S. PATENT DOCUMENTS

| | | | |
|---|---|---|---|
| 2,022,696 | 12/1935 | Tomlin et al. | 101/181 X |
| 2,444,547 | 7/1948 | Whitehead | 101/221 |
| 3,803,464 | 4/1974 | Kuroyanagi | 318/85 |
| 5,063,844 | 11/1991 | Fausel | 101/247 |
| 5,191,836 | 3/1993 | Weis | 101/219 |
| 5,309,834 | 5/1994 | Koch | 101/248 |
| 5,671,636 | 9/1997 | Gagne et al. . | |

FOREIGN PATENT DOCUMENTS

| | | |
|---|---|---|
| 44 05 658 C2 | 9/1995 | Germany . |
| 63-236651 | 10/1988 | Japan . |
| 2 309 668 | 8/1997 | United Kingdom . |

*Primary Examiner*—J. Reed Fisher
*Attorney, Agent, or Firm*—Kenyon & Kenyon

[57] ABSTRACT

An imprinter printing unit for a web fed rotary printing press comprises a first print couple including a first plate cylinder and an associated first blanket cylinder, a second print couple including a second plate cylinder and an associated second blanket cylinder, a first drive motor and a second drive motor. The printing unit further comprises a gear arrangement with axially movable gear wheels for operating the unit in a first mode of operation, in which the first drive motor drives the first print couple and the second drive motor independently drives the second print couple; a second mode of operation, in which the first drive motor commonly drives the first blanket cylinder and the second print couple; and in a third mode of operation, in which the second drive motor commonly drives the second blanket cylinder and the first print couple.

22 Claims, 6 Drawing Sheets

IMPRINTER PRINTING UNIT FOR A WEB ROTARY PRINTING PRESS

FIELD OF THE INVENTION

The present invention is related to an imprinter printing unit for a web fed rotary printing press. In particular, the invention is related to a motor- and gear arrangement for driving the cylinders of an imprinter printing unit in different modes of operation:

STATE OF THE ART

In a lithographic web-fed rotary printing press, a running paper web is usually fed through a plurality of blanket-to-blanket printing units, which apply a multicolor image to both sides of the web.

However, when printing commercials magazines or newspapers, it is often desired to change one or more printing plates mounted to the plate cylinders of the press, without interrupting the printing operation. An exchange of the printing plates may for instance be desirable, if during a running newspaper production, the latest news have to be actualized and printed on the front page of the current editions or if different editions of the same newspaper are distributed, in different areas under different names, so that the title of the newspaper has to be changed during the production run.

U.K. Patent Application No. GB 2 309 668 discloses a blanket-to-blanket printing unit for carrying out a flying plate exchange in which the plate cylinders remain in rolling contact with the running web, while the blanket cylinders of the unit are alternately engaged and disengaged with their associated blanket cylinder. The blanket cylinders are constantly coupled to each other via meshing pinion gears and are driven by the main drive motor of the press via a line shaft. The blanket cylinders, however, are coupled to the pinion gears of the blanket cylinders via clutches and associated further pinion gears respectively. For exchanging the printing plates of one of the plate cylinders, while the press is in operation, the drive connection to the plate cylinder is interrupted by activating the respective clutch and the plate cylinder is decelerated by an auxiliary motor. After exchanging the printing plates, the auxiliary motor reaccelerates the plate cylinder up to press speed, before it is reengaged with its associated blanket cylinder. Hence, besides the line shaft and the main drive motor, at least two further auxiliary motors are required for performing a flying plate exchange. Moreover, the unit is complicated in design and is likely to be subject to torsional disturbances in the gear train for driving the cylinders.

U.S. Pat. No. 5,063,844 describes a lithographic rotary printing press having a blanket-to-blanket printing unit, in which two plate cylinders can be alternatingly engaged and disengaged with one of the blanket cylinders, in order to carry out a flying plate exchange, while the printing press is in operation. During the flying plate exchange, both blanket cylinders of the printing unit are driven and are in rolling contact with the running paper web, while the plate cylinder which has been disengaged from the blanket cylinder is disconnected from the common drive motor, decelerated to a stop and reaccelerated after the printing plates have been changed.

German Patent No. DE 44 05 658 C2 describes a printing unit of a lithographic web fed rotary printing press for carrying out an on the run exchange of printing plates. The printing unit comprises two blanket cylinders and associated plate cylinders respectively, which can be alternately engaged and disengaged with an impression cylinder over which the running web is passed. Each of the blanket cylinders is driven by its own separate motor and drives the associated plate cylinder via a gear train. The impression cylinder is driven by a further separate motor. With the described imprinter printing unit, it is not possible to alternately print on both sides of the web.

Japanese Patent Document No. 63-236651 purports to disclose a blanket-to-blanket printing unit for a web-fed rotary printing press, in which an upper blanket cylinder and an associated upper plate cylinder are drivingly connected via a first gear train and in which a lower blanket cylinder and an associated lower plate cylinder are drivingly connected via a second gear train. A first motor is driving the upper plate cylinder and a second motor is driving the lower plate cylinder. However, due to the permanent coupling between the drive gears of the plate and associated blanket cylinders, the described printing unit can not be operated as an imprinter printing unit.

One of the main problems which arises during the operation of printing units is the occurrence of torsional disturbances within the gear train for driving the printing unit, which usually result in a severe loss of print quality or even in a doubling of the printed images.

SUMMARY OF THE INVENTION

Having outlined the state of the art and its attendant disadvantages, it is an object of the present invention to provide for an imprinter printing unit for a web fed rotary printing press, which has a compact design and a reduced number of drive motors and which allows a flying exchange of printing plates on either side of the web, while at the same time printing on the other side of the web, respectively.

Moreover, it is a further object of the present invention, to provide for an imprinter printing unit in which torsional disturbances in the unit drive are minimized.

BRIEF DESCRIPTION OF THE DRAWINGS

Other objects and advantages of the present invention will become apparent to those skilled in the art from the following detailed description of preferred embodiments, when read in conjunction with the accompanying drawings, wherein like elements have been designated with like reference numerals and wherein.

DETAILED DESCRIPTION OF THE PREFERRED EMBODIMENTS

Figure 1A:
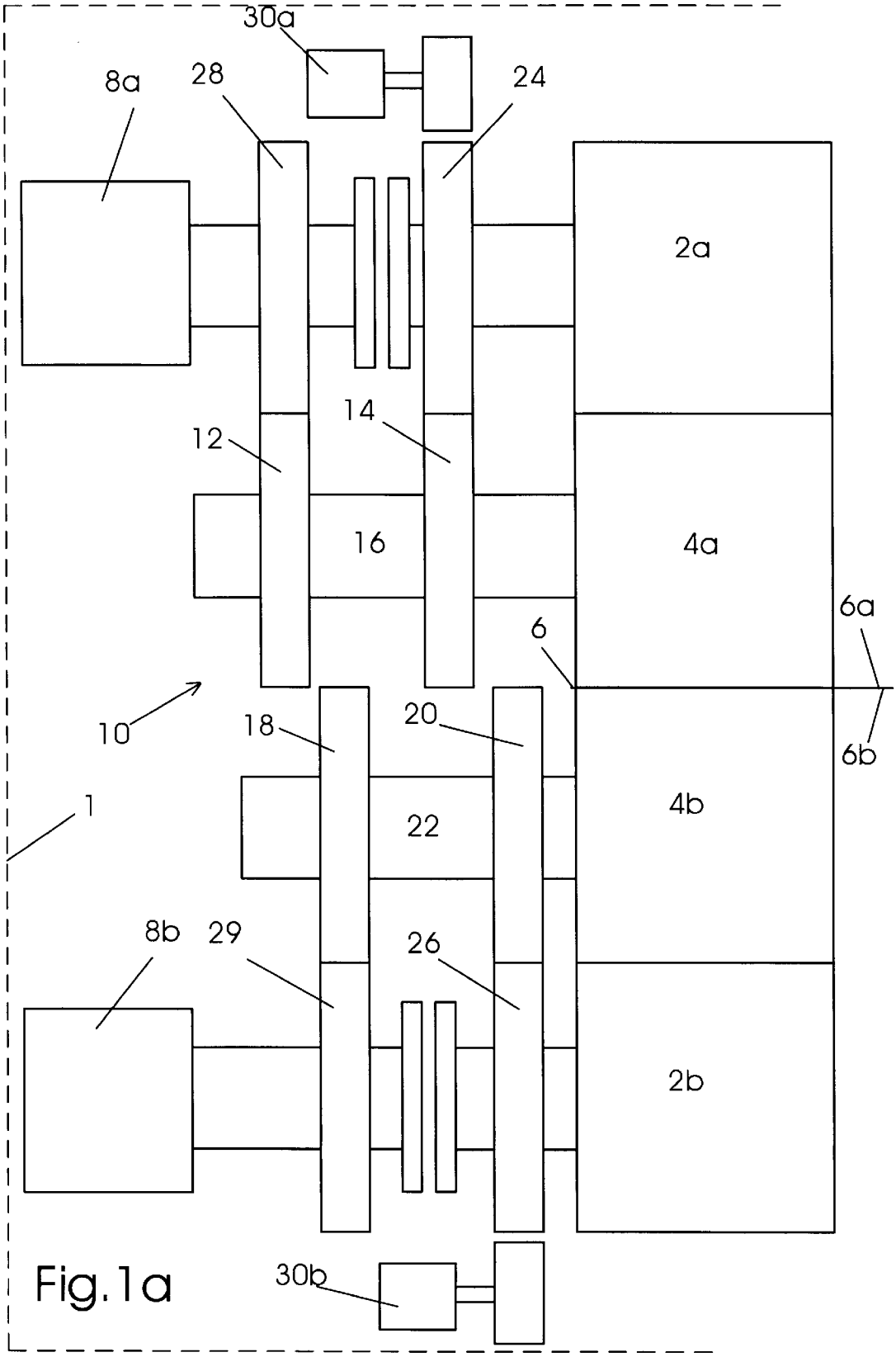
FIG. 1*a* is a schematic view of a first embodiment of an imprinter printing unit when operated in a first mode, in which both sides of a running web are printed with an image.
Figure 1B:
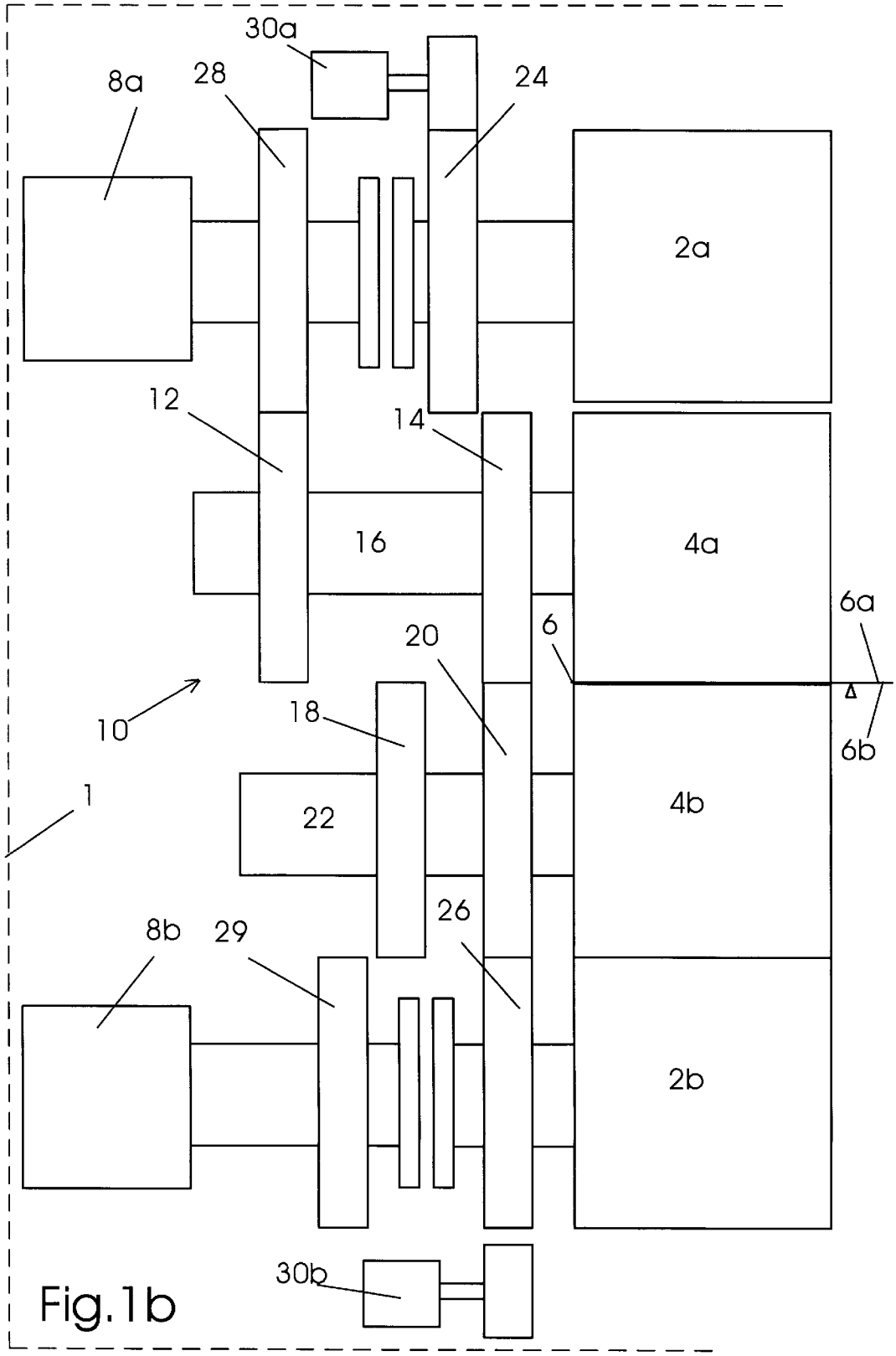
FIG. 1*b* is a schematic view of the printing unit of FIG. 1*a*, when operated in a second mode of operation, in which the web is printed on its lower side, while exchanging the printing plates of the upper plate cylinder.
Figure 1C:
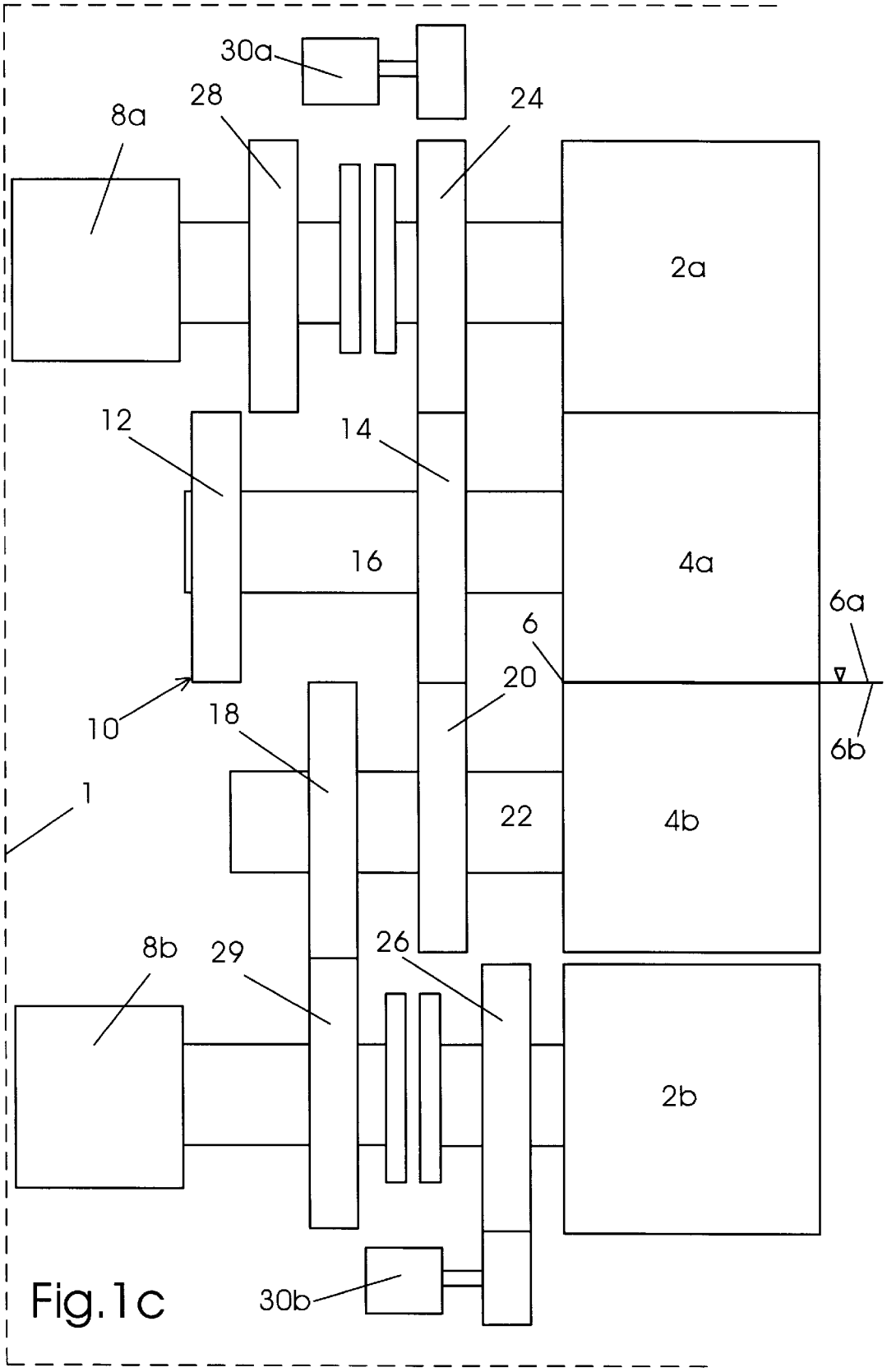
FIG. 1*c* is a schematic view of the printing unit of FIG. 1*a*, when operated in a third mode of operation, in which the web is printed on its upper side, while exchanging the printing plates of the lower plate cylinder.

As it is shown in FIGS. 1*a* to 1*c*, a first embodiment of an imprinter printing unit 1 of a web fed rotary printing press includes a first plate cylinder 2*a* and a first blanket cylinder 4*a* which form a first print couple for printing on a first side 6*a* of a running paper web 6. The printing unit 1 further includes a second plate cylinder 2*b* and an associated second blanket cylinder 4*b* which form a second print couple for printing on the second side 6*b* of the web 6 which runs through the nip formed between the first and second blanket cylinders 4*a* and 4*b*.

The printing unit 1 further includes a first and a second drive motor 8*a*, 8*b* for driving the cylinders 2*a*, 2*b* and 4*a*, 4*b* of the printing unit 1 in different modes of operation, which are hereinafter referred to as the first, second and third mode. In the first mode of operation, the running paper web 6 is printed on its first side 6*a* and second side 6*b* simultaneously, as it is indicated by the wedges in FIG. 1*a*.

In the second mode of operation, which is shown in FIG. 1*b*, the web 6 is only printed by the second print couple on its second side 6*b*, whereas the first plate cylinder 2*a* of the first print couple is separated from its associated first blanket cylinder 4*a*, e.g. for exchanging the printing plates (not shown) of the first plate cylinder 2*a*, while the printing press is in operation. During this second mode of operation, the first and second blanket cylinders 4*a* and 4*b* remain under impression, so that the first blanket cylinder 4*a* only acts as an impression cylinder without transferring an images to the first side 6*a* of the web 6.

However, in the third mode of operation, the web 6 is only printed by the first print couple on its first side 6*a*, whereas the second plate cylinder 2*b* is separated from its associated second blanket cylinder 4*b* for exchanging the printing plates on the second plate cylinder 2*b* for a next print job, as it is indicated in FIG. 1*c*. During this third mode of operation, the first and second blanket cylinders 4*a* and 4*b* remain under impression, so that the second blanket cylinder 4*b* only acts as an impression cylinder without transferring an images to the second side 6*b* of the web 6.

The printing unit 1 according to the first exemplary embodiment of the present invention further comprises a gear arrangement 10 for coupling the first and second plate- and blanket cylinders 2*a*, 2*b*, 4*a*, 4*b* to the first and second drive motors 8*a*, 8*b*, in order to drive the cylinders in such a way that in the first mode of operation (FIG. 1*a*), the first drive motor 8*a* drives the first print couple and the second drive motor 8*b* independently drives the second print couple; in the second mode of operation (FIG. 1*b*), the first drive motor 8*a* commonly drives the first blanket cylinder 4*a* and the second print couple; and in the third mode of operation (FIG. 1*c*) the second drive motor 8*b* commonly drives the second blanket cylinder 4*b* and the first print couple.

As it can be seen form FIGS. 1*a* to 1*c*, the gear arrangement 10 comprises first and second movable gear wheels 12, 14 which are mounted to the drive shaft 16*a* of the first blanket cylinder 4*a*. The first and second movable gear wheels 12, 14 are fixedly connected to the drive shaft 16 in the circumferential direction, in order to transmit torque to the drive shaft 16, but are movable on the drive shaft 16 in the axial direction thereof. The gear arrangement 10 further includes a third and a fourth movable gear wheel 18, 20, which are axially movably mounted to the drive shaft 22 of the second blanket cylinder 4*b*, but are fixedly connected to the drive shaft 22 in the circumferential direction, in order to transmit torque to the drive shaft 22. The gear arrangement 10 further comprises a first plate cylinder drive gear wheel 24 which is coupled to the first plate cylinder 2*a* and a second plate cylinder drive gear wheel 26 which is coupled to the second plate cylinder 2*b*.

In the first mode of operation (FIG. 1*a*), the first drive motor 8*a* drives the first movable gear wheel 12, preferably via a first pinion gear 28 which is connected to the drive shaft of the first motor 8*a*. The second movable gear wheel 14 is located at an axial position on the shaft 16, in which its teeth are in a meshing engagement with the teeth of the first plate cylinder drive gear wheel 24 for driving the first plate cylinder 2*a*. In the same way, the second drive motor 8*b* drives the third movable gear wheel 18, preferably via a pinion gear 29, and the fourth movable gear wheel 20 is located at an axial position on the shaft 22, in which its teeth are in a meshing engagement with the second plate cylinder drive gear wheel 26, for driving the second plate cylinder 2*b*.

In the second mode of operation (FIG. 1*b*), the first drive motor 8*b* drives the first movable gear wheel 12 and the second movable gear wheel 14 is located at an axial position on the shaft 16, in which its teeth are in meshing engagement with the teeth of the fourth movable gear wheel 20 and at the same time, the teeth of the fourth movable gear wheel 20 are in meshing engagement with the teeth of the second plate cylinder drive gear wheel 26, for driving the second plate cylinder 2*b*. A shift of the gear arrangement 10 from the first mode of operation to the second mode of operation may e.g. be achieved by simply moving the second and third movable gear wheels 14, 18 towards the their associated blanket cylinders 4*a*, 4*b*, respectively.

Accordingly, in the third mode of operation (FIG. 1*c*), the second drive motor 8*b* drives the third movable gear wheel 18 and the fourth movable gear wheel 20 is moved into an axial position, in which its teeth are in meshing engagement with the teeth of the second movable gear wheel 14. The second movable gear wheel 14 however, is arranged at an axial position on the shaft 22, in which its teeth are in meshing engagement with the teeth of the first plate cylinder drive gear wheel 24, as it is indicated in FIG. 1*c*. A shift from the first mode of operation to the third mode of operation may e.g. be achieved by simply moving the first movable gear wheel 12 and the fourth movable gear wheel 20 away from their associated blanket cylinders 4*a*, 4*b*, respectively.

In order to rotate the first plate cylinder 2*a* in the second mode and the second plate cylinder 2*b* in the third mode of operation, e.g. for exchanging the printing plates on the cylinders after separating them from their associated blanket cylinders, respectively, a first and second auxiliary motor 30*a*, 30*b* may be used. The first and second auxiliary motors 30*a*, 30*b* may be located adjacent to the first and second plate cylinder drive gear wheels 24, 26 and may be driving the drive gear wheels 24, 26 e.g. by pinion gears as indicated in the drawings, or by a friction roller or a drive belt and associated pulleys.

Moreover, instead of using auxiliary motors 30*a*, 30*b*, the second drive motor 8*b* may also be used for rotating the separated first plate cylinder 2*a* in the second mode of operation via a drive belt, whereas in the third mode of operation, the first drive motor 8*a* may rotate the second separated plate cylinder 2*b* in the same way via a further belt.

According to a preferred embodiment of the present invention, the first and third movable gear wheel 12, 20 and/or the second and fourth movable gear wheel 14 and 18 may be simultaneously movable on their associated shafts 16 and 22, respectively, e.g. by using a shift fork, as it is used in known prior art change-over gears.

Moreover, inking units for inking the first and second plate cylinders 2*a*, 2*b* may also be driven via the first and second plate cylinder drive gear wheels 24, 26. The inking units act as additional driven loads which aid in further minimizing remaining torsional disturbances which may be generated by the elasticity of the gear wheels and shafts of the gear arrangement 10.

Clutches may also be employed in the first embodiment of the invention, for providing an additional drive connection between the first and second drive motors 8*a*, 8*b* and the drive shafts of the associated plate cylinders 2*a*, 2*b*, as it is indicated in dashed lines in FIGS. 1*a* to 1*c*, in order to further minimize torsional disturbances.

Figure 2A:
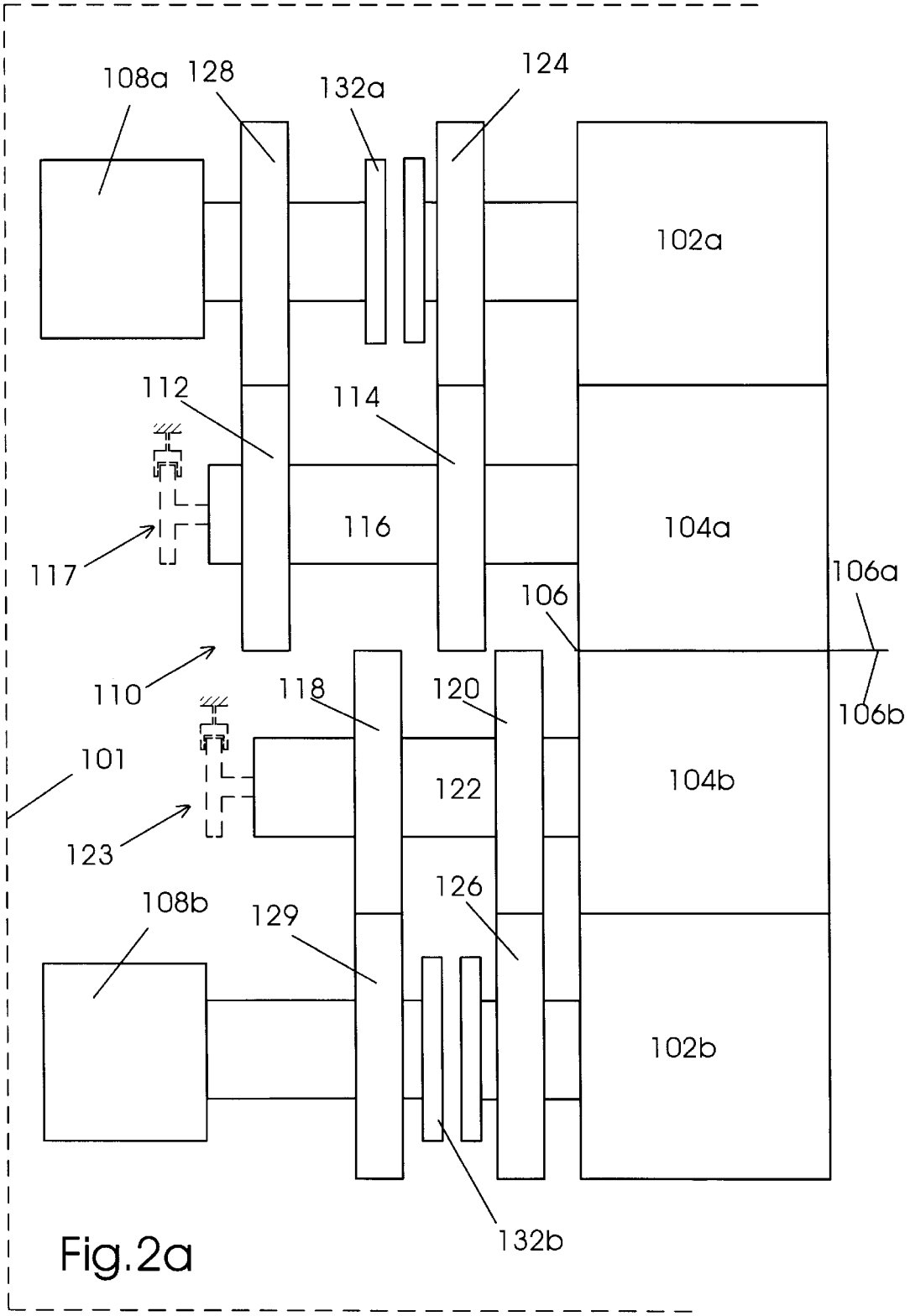
FIG. 2*a* is a schematic view of a second embodiment of an imprinter printing unit when operated in a first mode, in which both sides of a running web are printed with an image.
Figure 2B:
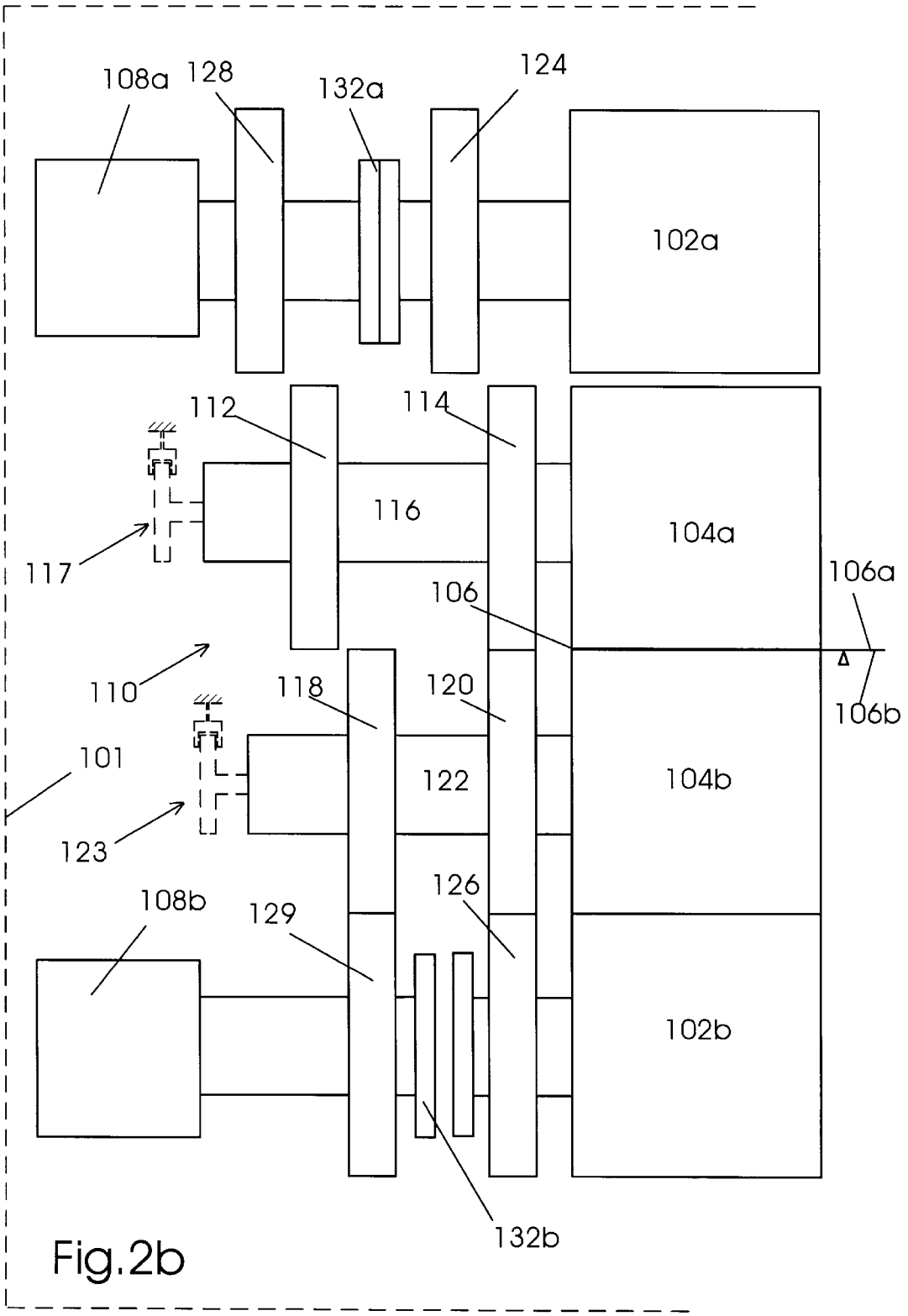
FIG. 2*b* is a schematic view of the printing unit of FIG. 2*a*, when operated in a second mode of operation, in which the web is printed on its lower side, while exchanging the printing plates of the upper plate cylinder.
Figure 2C:
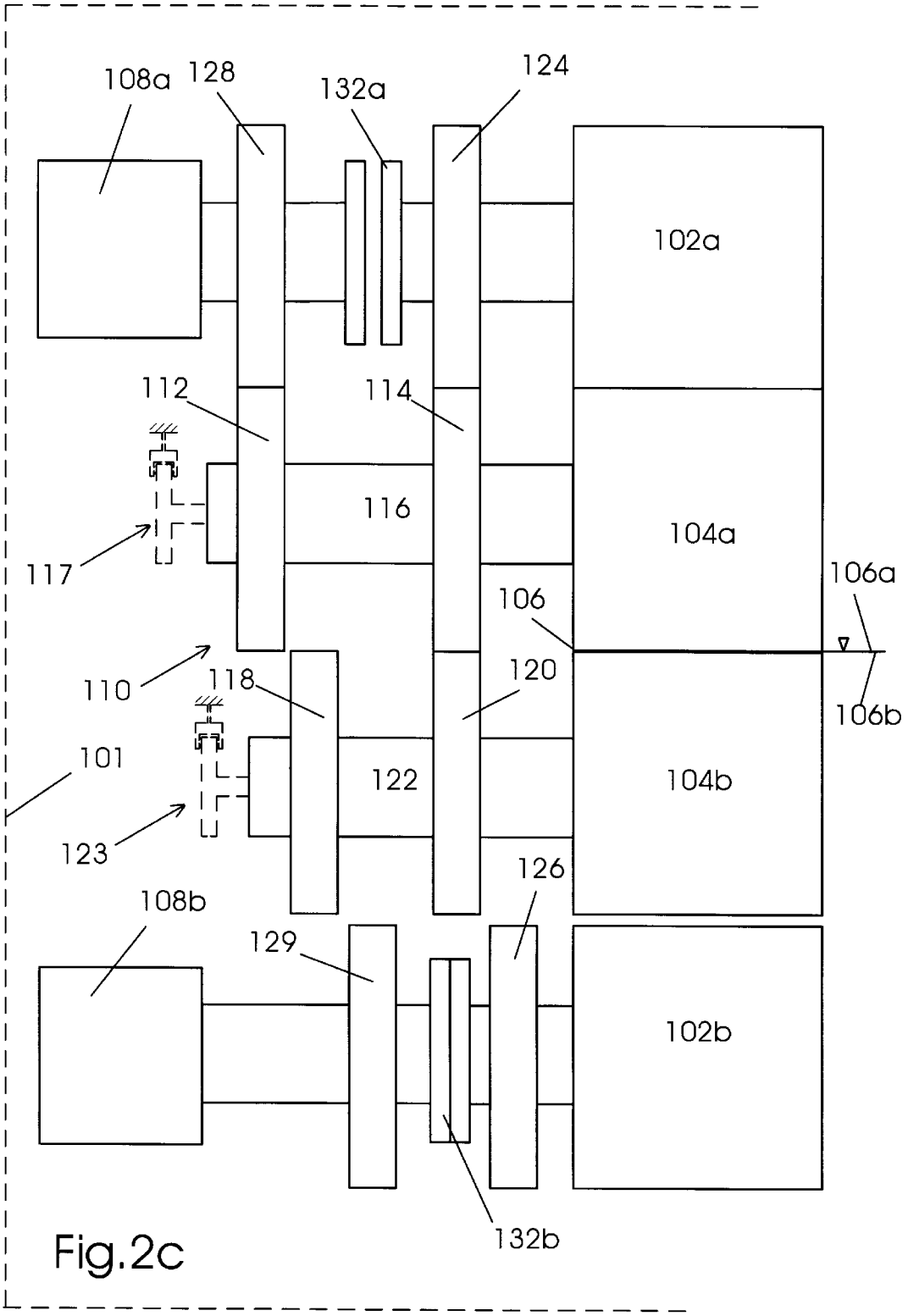
FIG. 2*c* is a schematic view of the printing unit of FIG. 2*a*, when operated in a third mode of operation, in which the web is printed on its upper side, while exchanging the printing plates of the lower plate cylinder.

As it is shown in FIGS. 2*a* to 2*c* in which similar parts are indicated with similar reference numerals increased by 100, a second embodiment of an imprinter printing unit 101 for a web fed rotary printing press includes a first plate cylinder 102*a* and a first blanket cylinder 104*a* which form a first print couple for printing on a first side 106*a* of a running paper web 106. The printing unit 101 further includes a second plate cylinder 102*b* and an associated second blanket cylinder 104*b* which form a second print couple for printing on the second side 106*b* of the web 106 which runs through the nip formed between the first and second blanket cylinders 104*a* and 104*b*.

The printing unit 101 further includes a first and as second drive motor 108*a*, 108*b* for driving the cylinders 102*a*, 102*b* and 104*a*, 104*b* of the printing unit 101 in different modes of operation, which are hereinafter referred to as the first, second and third mode. In the first mode of operation, the running paper web 106 is printed on its first side 106*a* and second side 106*b* simultaneously, as it is indicated by the wedges in FIG. 2*a*.

In the second mode of operation, which is shown in FIG. 2*b*, the web 106 is only printed by the second print couple on its second side 106*b*, whereas the first plate cylinder 102*a* of the first print couple is separated from its associated first blanket cylinder 104*a*, e.g. for exchanging the printing plates on the first plate cylinder 102*a*, while the printing press is in operation. During this second mode of operation, the first and second blanket cylinders 104*a* and 104*b* remain under impression, so that the first blanket cylinder 104*a* only acts as an impression cylinder without transferring an images to the first side 106*a* of the web 106.

However, in the third mode of operation, the web 106 is only printed by the first print couple on its first side 106*a*, whereas the second plate cylinder 102*b* is separated from its associated second blanket cylinder 104*b* for exchanging the printing plates (not shown) on the second plate cylinder 102*b* for a next print job, as it is indicated in FIG. 2*c*. During this third mode of operation, the first and second blanket cylinders 104*a* and 104*b* remain under impression, so that the second blanket cylinder 104*b* only acts as an impression cylinder without transferring an images to the second side 106*b* of the web 106.

The printing unit 101 further comprises a gear arrangement 110 for coupling the first and second plate- and blanket cylinders 102*a*, 102*b*, 104*a*, 104*b* to the first and second drive motors 108*a*, 108*b*, in order to drive the cylinders in such a way that in the first mode of operation (FIG. 2*a*), the first drive motor 108*a* drives the first print couple and the second drive motor 108*b* independently drives the second print couple; in the second mode of operation (FIG. 2*b*), the second drive motor 108*b* commonly drives the second print couple and the first blanket cylinder 104*a*; and in the third mode of operation (FIG. 2*c*), the first drive motor 108*a* commonly drives the first print couple and the second blanket cylinder 104*b*.

As it can be seen from FIGS. 2*a* to 2*c*, the gear arrangement 110 comprises a first and second movable gear wheel 112, 114 which are mounted to the drive shaft 116*a* of the first blanket cylinder 104*a*. The first and second movable gear wheels 112 and 114 are preferably fixedly connected to the drive shaft 116 in the circumferential direction, in order to transmit torque to the drive shaft 116, but are slidable on the drive shaft 116 in the axial direction thereof. The gear arrangement 110 further includes a third and a fourth movable gear wheel 118 and 120 which are axially movably mounted to the drive shaft 122 of the second blanket cylinder 104*b*, but are fixedly connected to the drive shaft 122 in the circumferential direction, in order to transmit torque to the drive shaft 122. The gear arrangement 110 further comprises a first plate cylinder drive gear wheel 124 which is coupled to the first plate cylinder 102*a* and a second plate cylinder drive gear wheel 126 which is coupled to the second plate cylinder 102*b*.

In the first mode of operation (FIG. 2*a*), the first drive motor 108*a* drives the first movable gear wheel 112, preferably via a first pinion gear 128 which is connected to the drive shaft of the first motor 108*a*. The second movable gear wheel 114 is located at an axial position on the shaft 116, in which its teeth are in a meshing engagement with the teeth of the first plate cylinder drive gear wheel 124 for driving the first plate cylinder 102*a*. In the same way, the second drive motor 108*b* drives the third movable gear wheel 118, preferably via a pinion gear 129, and the fourth movable gear wheel 120 is located at an axial position on the shaft 122, in which its teeth are in a meshing engagement with the second plate cylinder drive gear wheel 126, for driving the second plate cylinder 102*b*.

In the second mode of operation (FIG.2*b*), the second drive motor 108*b* drives the third movable gear wheel 118, and the fourth movable gear wheel 120 is moved on the shaft 122 into an axial position, in which its teeth are simultaneously in meshing engagement with the teeth of the second movable gear wheel 114 and the teeth of the second plate cylinder drive gear wheel 126, as it is indicated in FIG. 2*b*. A shift of the gear arrangement 110 from the first mode of operation to the second mode of operation may e.g. be achieved by simultaneously moving the first movable gear wheel 112 and the second movable gear wheel 114 towards their associated blanket cylinder 104*a*.

However, in the third mode of operation (FIG. 2*c*), the first drive motor 108*a* drives the first movable gear wheel 112 and the second movable gear wheel 114 is located at an axial position on the shaft 116, in which its teeth are simultaneously in meshing engagement with the teeth of the fourth movable gear wheel 120 and the teeth of the first plate cylinder drive gear wheel 124, for driving the first plate cylinder 102*a*. A shift of the gear arrangement 110 from the first mode of operation to the third mode of operation may e.g. be achieved by simply moving the third and fourth movable gear wheels 118, 120 away from their associated blanket cylinder 104*b*.

As it is shown in FIG. 2*b*, in the second mode of operation, the first drive motor 108*a* is exclusively coupled to the first plate cylinder 102*a*, in order to independently rotate the separated first plate cylinder 102*a* when exchanging printing plates mounted thereon during a flying plate exchange.

Accordingly, in the third mode of operation, the second drive motor 108*b* is exclusively coupled to the second plate cylinder 102*b*, in order to independently rotate the separated second plate cylinder 102*b* when exchanging printing plates mounted thereon during a flying plate exchange.

Pursuant to another exemplary embodiment of the present invention, the first and second drive motors 108*a*, 108*b* may be coupled their associated plate cylinders 102*a*, 102*b* via a first and second clutch 132*a*, 132*b*, respectively, as it is indicated in FIG. 2*a* to 2*c*. In this embodiment, the first clutch 132*a* is only engaged in the second mode and is disengaged when the printing unit is operated in the first and third mode, whereas the second clutch 132*b* is only engaged in the third mode and is disengaged in the first and second mode of operation. The advantage of using clutches 132*a* and 132*b* in the way as described before can be seen in that no further auxiliary motors are needed for rotating the first and second plate cylinders 102*a*, 102*b* during an on the run exchange of the printing plates, when the printing unit 101 is operated as an imprinter printing unit.

In the same way, it may also be possible to rotate the first and second plate cylinders of the second embodiment of the present invention using additional auxiliary motors or by a friction roller or a drive belt and associated pulleys, as described herein before in connection with the first embodiment of the present invention.

Moreover, inking units for inking the first and second plate cylinders 102*a*, 102*b* may also be driven via the first and second plate cylinder drive gear wheels 124, 126, providing an additional load which aids in further minimizing torsional disturbances within the printing unit 101.

An even further reduction of tensional disturbances and an elimination of doubling caused by backlash between the second and fourth movable gear wheel 114 and 120, particularly in the first mode of operation, may be obtained by mounting a brake 117, 123 to the drive shafts 116 and/or 122, which is preferably only activated in the first mode of operation. Alternatively or additionally, a known prior art anti-backlash device may also be used. An anti-backlash device is e.g. described in U.S. Pat. No. 5,671,636, the contents of which is hereby incorporated by reference.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. An imprinter printing unit for a web fed rotary printing press comprising:

a first print couple including a first plate cylinder and an associated first blanket cylinder;

a second print couple including a second plate cylinder and an associated second blanket cylinder;

a first drive motor; and a second drive motor, wherein in a first mode of operation the first drive motor drives the first print couple and the second drive motor independently drives the second print couple, in a second mode of operation the first drive motor drives the first blanket cylinder and the second print couple;

and wherein in a third mode of operation the second drive motor drives the second blanket cylinder and the first print couple.

2. The imprinter printing unit of claim 1, wherein in the second mode of operation, the first plate cylinder is independently driven by a first auxiliary motor.

3. The imprinter printing unit of claim 1, wherein in the third mode of operation, the second plate cylinder is independently driven by a second auxiliary motor.

4. The imprinter printing unit of claim 1, further comprising a gear arrangement, the gear arrangement including first and second gear wheels mounted axially movably to a drive shaft associated with the first blanket cylinder, third and fourth gear wheels mounted axially movably to a drive shaft associated with the second blanket cylinder; a first plate cylinder drive gear wheel coupled to the first plate cylinder and a second plate cylinder drive gear wheel coupled to the second plate cylinder.

5. The imprinter printing unit of claim 4, wherein in the first mode of operation, the first drive motor drives the first movable gear wheel and the second movable gear wheel is in meshing engagement with the first plate cylinder drive gear wheel for driving the first plate cylinder, and wherein the second drive motor drives the third movable gear wheel and the fourth movable gear wheel is in meshing engagement with the second plate cylinder drive gear wheel for driving the second plate cylinder.

6. The imprinter printing unit of claim 4, wherein in the second mode of operation, the first drive motor drives the first movable gear wheel and the second movable gear wheel is in meshing engagement with the fourth movable gear and the fourth movable gear wheel is in meshing engagement with the second plate cylinder drive gear wheel.

7. The imprinter printing unit of claim 4, wherein in the third mode of operation, the second drive motor drives the third movable gear wheel and the fourth movable gear wheel is in meshing engagement with the second movable gear wheel and the second movable gear wheel is in meshing engagement with the first plate cylinder drive gear wheel.

8. The imprinter printing unit of claim 4, wherein the first and third movable gear wheels are commonly slidable.

9. The imprinter printing unit of claim 4, wherein the second and fourth gear wheels are commonly slidable.

10. An imprinter printing unit for a web fed rotary printing press comprising:

a first print couple including a first plate cylinder and an associated first blanket cylinder, a second print couple including a second plate cylinder and an associated second blanket cylinder, a first drive motor, and a second drive motor, wherein in a first mode of operation, the first drive motor drives the first print couple and the second drive motor independently drives the second print couple, in a second mode of operation, the second drive motor drives the second print couple and the first blanket cylinder and wherein in a third mode of operation, the first drive motor drives the first print couple and the second blanket cylinder.

11. The imprinter printing unit of claim 10, wherein in the second mode of operation, the first drive motor is exclusively coupled to the first plate cylinder, to independently drive the first plate cylinder for exchanging printing plates mounted to the first plate cylinder, when the first plate cylinder is disengaged from its associated first blanket cylinder.

12. The imprinter printing unit of claim 11, wherein the first drive motor is coupled to the first plate cylinder via a clutch, the clutch being engaged in the second mode and being disengaged when the printing unit is operated in the first and third mode.

13. The imprinter printing unit of claim 10, wherein in the third mode of operation, the second drive motor is exclusively coupled to the second plate cylinder, to independently drive the second plate cylinder for exchanging printing plates mounted to the second plate cylinder, when the second plate cylinder is disengaged from its associated second blanket cylinder.

14. The imprinter printing unit of claim 13, wherein the second drive motor is coupled to the second plate cylinder via a clutch, the clutch being engaged in the third mode and being disengaged when the printing unit is operated in the first and second mode.

15. The imprinter printing unit of claim 10, further comprising a gear arrangement, the gear arrangement including a first and second gear wheel mounted axially movably to a drive shaft of the first blanket cylinder, a third and a fourth gear wheel mounted axially movably to a drive shaft of the second blanket cylinder; a first plate cylinder drive gear wheel coupled to the first plate cylinder and a second plate cylinder drive gear wheel coupled to the second plate cylinder.

16. The imprinter printing unit of claim 15, wherein in the first mode of operation, the first drive motor drives the first movable gear wheel and the second movable gear wheel is in meshing engagement with the first plate cylinder drive gear wheel for driving the first plate cylinder, and wherein the second drive motor drives the third movable gear wheel and the fourth movable gear wheel is in meshing engagement with a second plate cylinder drive gear wheel for driving the second plate cylinder.

17. The imprinter printing unit of claim 15, wherein in the second mode of operation, the second drive motor drives the third movable gear wheel and the fourth movable gear wheel is in meshing engagement with the second plate cylinder drive gear wheel and the second movable gear wheel.

18. The imprinter printing unit of claim 15, wherein in the third mode of operation, the first drive motor drives the first movable gear wheel and the second movable gear wheel is in meshing engagement with the first plate cylinder drive gear wheel and the fourth movable gear wheel.

19. The imprinter printing unit of claim 15, wherein the first and second movable gear wheels are commonly movable on the drive shaft of the first blanket cylinder.

20. The imprinter printing unit of claim 15, wherein the third and fourth gear wheels are commonly movable on the drive shaft of the second blanket cylinder.

21. The imprinter printing unit of claim 15, wherein a brake is mounted to the drive shaft of the first blanket cylinder for braking the first blanket cylinder in the first mode of operation.

22. The imprinter printing unit of claim 15, wherein a brake is mounted to the drive shaft of a second blanket cylinder for braking the second blanket cylinder in the first mode of operation.

* * * * *